United States Patent [19]

Demuth et al.

[11] Patent Number: 4,928,353

[45] Date of Patent: May 29, 1990

[54] METHOD AND MEANS FOR EFFECTING A CONTROLLABLE CHANGE IN THE PRODUCTION OF A FIBER-PROCESSING MACHINE

[75] Inventors: Robert Demuth, Nürensdorf; Paul Stäheli, Wilen b. Wil; Rene Wäber; Christoph Gründler, both of Winterthur; Franz Mächler, Neftenbach, all of Switzerland

[73] Assignee: Maschinenfabrik Rieter AG, Winterthur, Switzerland

[21] Appl. No.: 252,901

[22] Filed: Oct. 3, 1988

[30] Foreign Application Priority Data

Oct. 7, 1987 [CH] Switzerland ..... 03911/87

[51] Int. Cl.[5] ..... D01G 23/00

[52] U.S. Cl. ..... 19/65 A; 19/97.5; 19/105; 19/300

[58] Field of Search ..... 19/65 A, 97.5, 105, 19/300

[56] References Cited

U.S. PATENT DOCUMENTS

| | | | |
|---|---|---|---|
| 3,728,759 | 4/1973 | Hergeth | 19/105 |
| 4,272,868 | 6/1981 | Grunder et al. | 19/105 X |
| 4,393,547 | 7/1983 | Hösel | 19/105 |
| 4,494,204 | 1/1985 | Hösel | 19/105 X |
| 4,523,351 | 6/1985 | Leifeld | 19/105 |
| 4,657,444 | 4/1987 | Pinto | 19/105 X |
| 4,682,388 | 7/1987 | Pinto | 19/105 |
| 4,694,538 | 9/1987 | Pinto et al. | 19/105 |
| 4,734,957 | 4/1988 | Lenzen | 19/105 |

FOREIGN PATENT DOCUMENTS

| | | | |
|---|---|---|---|
| 0028291 | 5/1981 | European Pat. Off. | 19/65 A |
| 0093235 | 7/1985 | European Pat. Off. . | |
| 0149177 | 7/1985 | European Pat. Off. . | |
| 0221306 | 5/1987 | European Pat. Off. . | |
| 2164011 | 6/1972 | Fed. Rep. of Germany . | |
| 3229402 | 2/1984 | Fed. Rep. of Germany | 19/105 |
| 3149965 | 8/1984 | Fed. Rep. of Germany . | |
| 3542816 | 6/1987 | Fed. Rep. of Germany . | |
| 1170009 | 7/1985 | U.S.S.R. | 19/105 |
| 2102593 | 2/1983 | United Kingdom | 19/300 |
| 2183683 | 6/1987 | United Kingdom . | |

*Primary Examiner*—Werner H. Schroeder
*Assistant Examiner*—Sara M. Current
*Attorney, Agent, or Firm*—Werner W. Kleeman

[57] ABSTRACT

In order to effect a controllable change in the production of a fiber-processing machine there is changed the working width of the fiber-processing machine.

8 Claims, 1 Drawing Sheet

METHOD AND MEANS FOR EFFECTING A CONTROLLABLE CHANGE IN THE PRODUCTION OF A FIBER-PROCESSING MACHINE

BACKGROUND OF THE INVENTION

The present invention broadly relates to fiber-processing machines or installations comprising a plurality of different fiber-processing stages, and, more specifically, is concerned with an improved method and means for effecting a controllable change in the production of the fiber-processing machine or installation.

A short-staple spinning mill comprises a plurality of such fiber-processing stages between the bale store and the bobbin packing room or the bobbin conveyor system. In the "downstream" stages, normally after the card room the fibers are processed in the form of an elongate cohesive structure (a sliver, roving or yarn), while in the "upstream" stages the fibers are processed in different non-cohesive or relatively coarse forms, e.g. flying freely, in the form of a lap, in bales, and so on.

It is a well known fact that the "treatment" of the fibers in these upstream stages has a considerable influence on the quality of the end product. It is also well known that this "treatment" is dependent upon the throughflow per unit of time (the "production") in each processing stage, and this has led to attempts to render production as uniform as possible in the course of time by "continuous" operation of the installation and to achieve a better quality (for example, degree of cleaning) on average.

The problem, however, is that small inevitable changes in production cannot readily be compensated for, so that the on average better quality is obtained at the expense of small—but nevertheless unpleasant—variations in quality.

SUMMARY OF THE INVENTION

Therefore with the foregoing in mind it is a primary object of the present invention to provide a new and improved method and means for effecting a controllable change in the production of a fiber-processing machine in a manner which is not afflicted with the aforenoted shortcomings and drawbacks.

A further notable object of the present invention is concerned with perfecting in a highly accurate and reliable fashion a controllable change in the production of a fiber-processing machine or installation comprising a plurality of different fiber-processing stages by changing the working width of the machine or installation in order to control or regulate the total production thereof.

According to the present invention, changes in production, i.e. changes in the flow of material per unit of time, in a fiber-processing machine or installation are effected by changing the "processing width", i.e. by changing the width of the material flow (transversely of the direction of material flow) through the machine processing components, without any appreciable change in the throughflow per unit of time and importantly per unit length of the width. The "specific production" (i.e. the production per unit of time and per unit length of the effective machine width) can thus be kept substantially constant, resulting in a substantially constant quality. The total machine production (throughflow per unit of time over the entire width) can, however, be controllably changed.

The principle can be utilized to control or regulate a fiber-processing machine or installation. As in a conventional control or regulating process, a set or reference value can be determined for the total production of a processing stage and the processing width of that stage can be changed accordingly, either directly or in dependence on a deviation detected in a comparison between the set or reference value and the actual value.

The invention is particularly advantageous where the machine or installation operates with a feed in the form of a lap, and particularly in the control or regulation of a feed machine for a card line containing cards.

The invention also covers a fiber-processing apparatus comprising means for the controlled change of the working width of such apparatus. The apparatus could, for example, comprise a working component of variable effective length, for example, a working component consisting of a plurality of adjacent individually drivable working elements, so that it is possible to control the number of elements in operation. This variant could be utilized in bale opening as already indicated in the commonly assigned European patent application Ser. No. 221,306, published May 13, 1987. In another variant, the length of the working component can be kept constant while the width of the material feed is variable. For example, the width of a filling chute (parallel to the length of the feed roller) of a feed machine could be changed, for example as described in German Pat. No. 3,149,965, published Aug. 30, 1984 or German Patent Publication No. 3,542,816, published June 11, 1987.

The invention is advantageous in both continuously and discontinuously operating installations, that is to say, the individual stages normally run with a continuously variable production or operate in the stop-go mode, production remaining constant within a go interval. The invention can advantageously be combined with other control and regulating processes, for example, as in the commonly assigned European Pat. No. 93,235, published Nov. 9, 1983, which describes a method of optimizing stop/go conditions in a bale opener. Fine production variations have to be accepted in such conditions. Fine production variations of this kind could, for example, be effected by means of the present invention so that the specific production and hence the quality remain constant.

A method of regulating the card feed is described in the commonly assigned, U.S. application Ser. No. 07/228,539 filed Aug. 4, 1989, entitled "Fiber Processing Plant" based upon the basic cognate Swiss patent application Ser. No. 3109/87, filed Aug. 12, 1987. This method was designed primarily for use with a stop/go mode of operation in order to obviate the quality fluctuations associated with "continuous" operation. The combination of a method according to the aforementioned U.S. Application with the present method gives very much greater freedom in deciding the mode of operation.

Whether continuous or discontinuous (stop/go) mode of operation is selected a set or reference value for the total production of a stage may represent either the instantaneous production or the average (effective) production of the stage. The latter, however, can be determined only over a certain period of time (measuring period) and any production fluctuations (for example, stop intervals in stop/go operation, or changes in instantaneous production in the case of "continuous" operation) must be taken into account.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawing, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the fiber-processing machine or fiber-processing installation comprising a plurality of different fiber-processing stages has been illustrated therein as is needed to enable one skilled in the art to readily understand the underlying principles and concepts of this invention.

Figure 1:
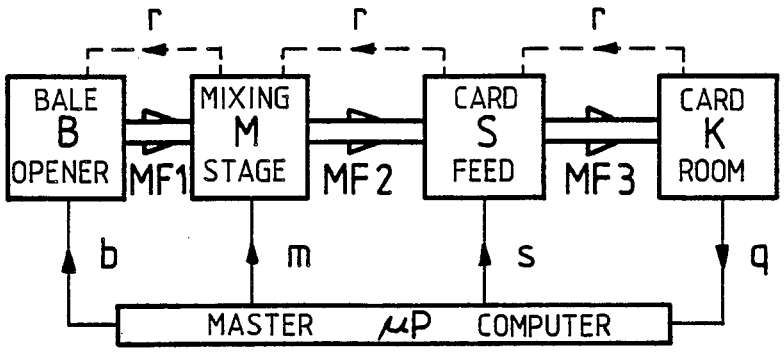
FIG. 1 is a diagram of a fiber-processing installation of a short-staple spinning mill.

Turning now specifically to FIG. 1 of the drawings, there is shown four processing stages in the blowing/opening room of a short-staple spinning mill. Stage K denotes the card room, stage S the card feed, stage M a mixing operation and stage B the bale opener. Other stages may also be provided, for example, an additional cleaning stage between the bale opener stage B and the mixing stage M. The entire installation is controlled by a master computer $\mu$P, a control signal g which represents the total production of the card room stage K being obtained and fed to the master computer $\mu$P so that the latter can determine the corresponding production of each stage preceding the cards of the card room stage K via corresponding lines s, m, b. The flow of material MF1, MF2, MF3 between the different stages is controlled in this way. Feedbacks r may also be provided between the stages B, M, S and K, as shown, so that each upstream stage determines its production by reference to two signals, namely a signal from the master computer $\mu$P and a signal from the immediately downstream stage. This arrangement is well known and can operate either continuously or discontinuously, as already described hereinbefore.

A variation in production in a preceding stage is normally effected by changing a roller speed, a feed speed or a "processing depth" (e.g. the depth of removal in a bale opener). In each case, however, this means changing the "specific production" i.e. the flow-through or throughflow (P) per unit of time (h) per unit of length (L) of the "processing width". The latter concept will now be explained in detail with reference to FIG. 2.

Figure 2:
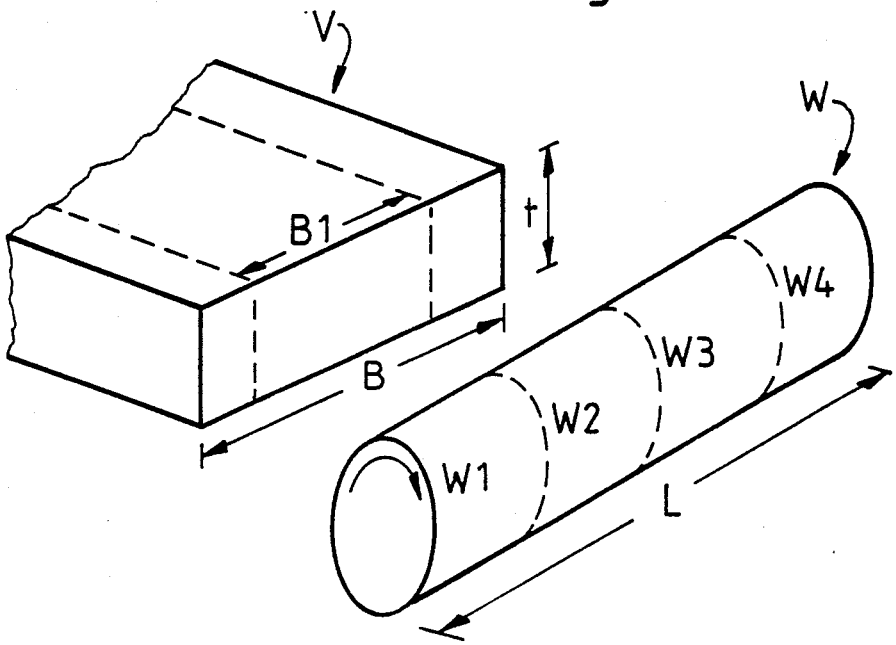
FIG. 2 is a diagram showing one working station of this installation in order to clarify the new principle.

FIG. 2 is a diagram showing a feed material or feed V and a working roller W of a working station. The roller W normally has a predetermined working length L provided, for example, with a covering or clothing or with projections or teeth to be able to process fibers over the entire length L. The feed material V normally has a corresponding width B (B=L), so that fibers are delivered over the entire length L to the working roller W. The technology (fiber processing) depends on the speed of rotation of the working roller W, its covering or clothing, the (predetermined) thickness t of the feed material V and the fiber density in the feed material V. A necessary change of production is normally effected by changing the roller speed. Since, however, the type of covering or clothing, feed material thickness and feed material density cannot be changed correspondingly, this means a change of technology (i.e. quality) in the conventional method. According to this invention, it is proposed that a production change should be effected by changing the effective length L and/or the effective width B, while all the other parameters can be kept constant and, in particular, the flowthrough per hour per unit of length of the working roller W can be kept constant.

The broken lines in FIG. 2 illustrate diagrammatically two possibilities of changing the production in this way, i.e. "widening" or "narrowing" the width of the feed material V, e.g. between the values B and B1, and lengthening or shortening the working length L of the working roller W by combining the working roller W from individually drivable adjacent roller sections W1 to W4.

Normally there will be no point in changing the working length L of the working roller W without making a corresponding change to the feed material width B, since otherwise, under certain operating conditions, edge parts of the feed material V are not processed, and this might have an adverse effect.

The invention is not restricted to use in conjunction with working means in the form of rollers, nor to a feed material in the form of a lap. In a cleaning station where the fibers are conveyed through the machine in the form of freely flying flocks, the effective working width of the machine can also be changed in accordance with this invention.

While there are shown and described present preferred embodiments of the invention, it is to be distinctly understood that the invention is not limited thereto, but may be otherwise variously embodied and practiced within the scope of the following claims. Accordingly,

What we claim is:

1. A method of adjusting the production of a fiber-processing installation containing a plurality of consecutive different fiber-processing stages, comprising the steps of:

monitoring the total production of the fiber-processing installation in terms of material throughflow per unit time and per unit length of an effective working width of a last one of the plurality of consecutive different fiber-processing stages; and changing a variable effective working width of at least one predetermined fiber-processing stage preceding said last one of the plurality of consecutive different fiber-processing stages of the fiber-processing installation in order to effect a change in the production of the fiber-processing installation in terms of said material throughflow per unit time and per unit length of said effective working width of said last one of said plurality of consecutive different fiber-processing stages.

2. The method as defined in claim 1, further including the steps of:

using as the at least one predetermined fiber-processing stage a lap-processing card feeder for feeding at least one card; and using said at least one card as said last one of said plurality of consecutive different fiber-processing stages.

3. The method as defined in claim 1, further including the steps of:

generating at said last one of said plurality of consecutive different fiber-processing stages of said fiber-processing installation, a control signal indicative of said material throughflow per unit time and per unit length of said effective working width of said last one of said plurality of consecutive different fiber-processing stages; and said step of changing said variable effective working width of said at least one predetermined fiber-processing stage entails controlledly changing said variable effective working width of said at least one predetermined fiber-processing stage under the control of said control signal in order to thereby controlledly change said production of said fiber-processing installation.

4. The method as defined in claim 3, wherein:

said step of generating said control signal entails generating, at said last one of said plurality of consecutive different fiber-processing stages, a control signal indicative of a deviation from a preset reference value of said material throughflow per unit time and per unit length of said effective working width of said last one of said plurality of consecutive different fiber processing stages; and said step of controlledly changing said variable effective working width of said at least one predetermined fiber-processing stage under the control of said control signal entails regulating said production of said fiber-processing installation in response to said control signal.

5. A fiber-processing installation, comprising:

means defining a plurality of consecutive different fiber-processing stages;

said plurality of consecutive different fiber-processing stages containing a last fiber-processing stage and at least one predetermined fiber-processing stage preceding said last fiber-processing stage;

said at least one predetermined fiber-processing stage having a variable effective working width;

said last fiber-processing stage having an effective working width and thereby defining a predeterminate production of the fiber-processing installation in terms of material throughflow per unit time and per unit length of said effective working width of said last fiber-processing stage; and adjusting means operatively connected to said last fiber-processing stage for changing said variable effective working width of said at least one predetermined fiber-processing stage in order to thereby adjust said predeterminate production of the fiber-processing installation.

6. The fiber-processing installation, as defined in claim 5, further including:

means for generating a control signal indicative of said predeterminate production of the fiber-processing installation;

said control signal generating means being associated with said last fiber-processing stage; and said adjusting means being connected to said control signal generating means for changing the variable effective working width of said at least one predetermined fiber-processing stage.

7. The fiber-processing installation as defined in claim 6, further including:

a reference signal generator generating a reference signal indicative of a preset value of said predeterminate production of the fiber-processing installation;

said reference signal generator being connected to said control signal generating means for producing a control signal indicative of a deviation between said preset value and an actual value of said production of said fiber-processing installation; and said adjusting means regulating the production of said fiber-processing installation.

8. The fiber-processing installation as defined in claim 5, wherein:

said last fiber-processing stage constitutes at least one card; and said at least one predetermined fiber-processing stage preceding said last fiber-processing stage, constitutes a lap-processing card feeder feeding said at least one card.

* * * * *